United States Patent [19]

Doherty et al.

[11] Patent Number: 4,886,466

[45] Date of Patent: Dec. 12, 1989

[54] SEALED ELECTRICAL AND PNEUMATIC CONNECTOR

[75] Inventors: Paul D. Doherty, Bellbrook; Timothy N. Tackett; Lawrence R. Gavin, both of Warren, all of Ohio

[73] Assignee: General Motors Corporation, Detroit, Mich.

[21] Appl. No.: 199,247

[22] Filed: May 26, 1988

[51] Int. Cl.[4] ..... H01R 4/64

[52] U.S. Cl. ..... 439/191

[58] Field of Search ..... 439/190–192, 439/198; 188/322.16, 322.17, 299, 301

[56] References Cited

U.S. PATENT DOCUMENTS 455,021 6/1891 Krehbiel ..... 439/192

2,631,185 3/1953 Earle et al. ..... 439/191

*Primary Examiner*—Eugene F. Desmond

*Attorney, Agent, or Firm*—F. J. Fodale

[57] ABSTRACT

A sealed electrical and pneumatic connector for a hollow piston rod or the like comprises mating connector bodies which provide pneumatic and multiple electrical interfaces. The pneumatic interface includes a hose which carries seals and a slide for sealing the pneumatic interface effectively. The upper connector body houses conductor seals and carries an external seal sleeve for sealing the opening of the hollow piston rod. The upper connector is retained by a retainer which assures proper positioning of the electrical terminals. The retainer is locked by a clamp which assures proper mating of the connector bodies.

7 Claims, 2 Drawing Sheets

SEALED ELECTRICAL AND PNEUMATIC CONNECTOR

BACKGROUND OF THE INVENTION

This invention relates generally to connectors and more particularly to sealed electrical and pneumatic connectors.

SUMMARY OF THE INVENTION

The object of this invention is to provide a sealed connector for supplying electricity and air or gas to a device such as the automotive suspension strut which is disclosed in U.S. Pat. Nos. 4,576,258 and 4,660,688 granted to Andrew M. Spisak and Robert L. Adduci on Mar. 18, 1986 and Apr. 28, 1987, respectively.

A feature of the invention is that pneumatic and multiple electrical interfaces are contained within a single pair of matable connectors so that the pneumatic and multiple electrical interfaces are completed simultaneously when the two connectors are mated.

Another feature of the invention is that the matable connectors are compact enough to fit in the hollow piston rod of a suspension strut or shock absorber or the like.

Another feature of the invention is a unique arrangement for sealing the pneumatic interface with respect to the connector bodies of the mated connectors.

Another feature of the invention is a unique latching arrangement for retaining an external elastomeric seal sleeve on one of the connector bodies for sealingly engaging the bore of the hollow piston rod or the like in which the connector is housed.

Another feature of the invention is a terminal position assurance (TPA) retainer for one of the connectors which assures proper positioning of the terminals within its connector body as well as retains the one connector in its mated position within the hollow piston rod or the like in which the connector is housed.

Still yet another feature of the invention is a connector position assurance (CPA) lock which cooperates with the TPA retainer to assure proper connection on the mated connectors.

Still yet another feature of the invention is that the TPA retainer and the CPA lock are both retained by the same cooperative structure of the hollow piston rod.

Other objects and features of the invention will become apparent to those skilled in the art as the disclosure is made in the following detailed description of a preferred embodiment of the invention.

DESCRIPTION OF THE PREFERRED EMBODIMENT

Figure 1:
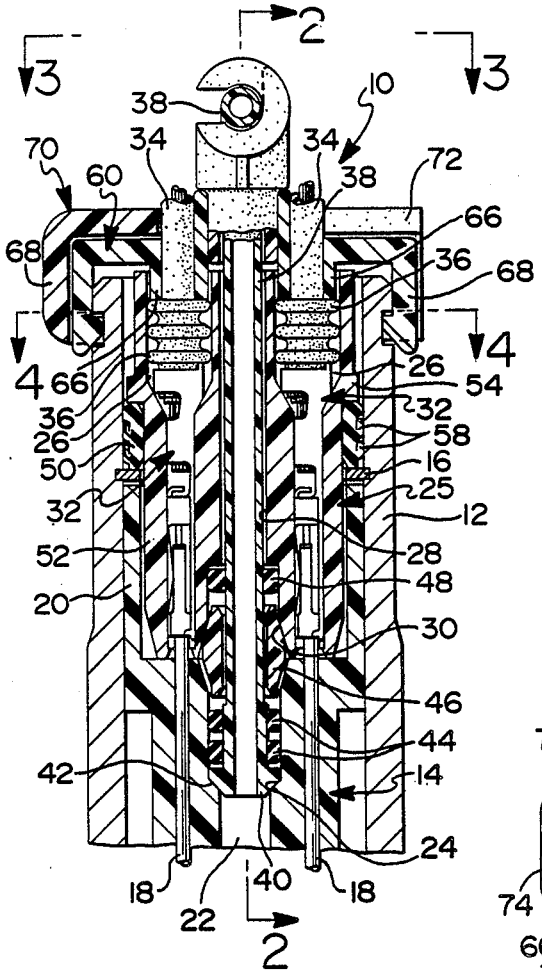
FIG. 1 is a partial cross section view of a sealed electrical and pneumatic connector in accordance with this invention.

Referring now to the drawing the connector 10 of this invention is shown in conjunction with a hollow metallic piston rod 12 of an automotive suspension strut (not shown).

The connector 10 comprises a thermoplastic male connector body 14 which is located in the piston rod by means of snap-ring 16. The male connector body 14 has a plurality of inserted molded male pin terminals 18 which project into an upper shroud 20 of the connector body 14. The male pin terminals 18 are arrayed around a central pneumatic passage 22 in the connector body 14 which is enlarged at the upper end to form a tapered seat 24. The enlarged upper end of the pneumatic passage 22 opens into the cavity of the shroud 20.

The connector 10 further comprises a thermoplastic female connector body 25 which is inserted into the open end of the hollow piston rod 12 and plugged into the male connector body 14 which is housed in the hollow piston rod 12. The female connector body 25 has a plurality of terminal cavities 26 which are arrayed around a central passage 28 which has an enlarged lower end which terminates in a tapered seat 30. The female connector body 25 has female terminals 32 housed in the terminal cavities 26 which mate with the male pin terminals 18 when the female connector body 25 is plugged into the male connector body 14. The female terminals 32 are attached to insulated conductors 34 by conventional crimp barrel portions. The conductor ends of the terminal cavities 26 are sealed by individual seal sleeves 36 which are attached to the ends of the conductors 34 by the crimp barrels of the female terminals 32 in a known manner.

The female connector body 25 has a thermoplastic hose 38 which is inserted into the central passage 28 via the enlarged lower end. The lower end of the hose 38 has a flange 40 which has a tapered face 42 which mates with the tapered seat 24 of the male connector body 14. A pair of lower elastomeric O-ring seals 44, an intermediate thermoplastic sleeve 46 and an upper elastomeric O-ring seal 48 are disposed on the end of the hose 38 above the flange 40. The lower O-ring seals 44 provide a seal between the hose 38 and the male connector body 14 while the upper O-ring seal 48 provides the seal between the hose 38 and the female connector body 25. The intermediate sleeve 46 which is slideably mounted on the hose 38 engages the tapered seat 30 of the female connector body 25 to insure that the lower O-ring seals 44 are positioned properly for sealing engagement with the enlarged upper end of the central pneumatic passage 22 in the male connector body 14. This effectively seals the pneumatic interface.

Figure 2:
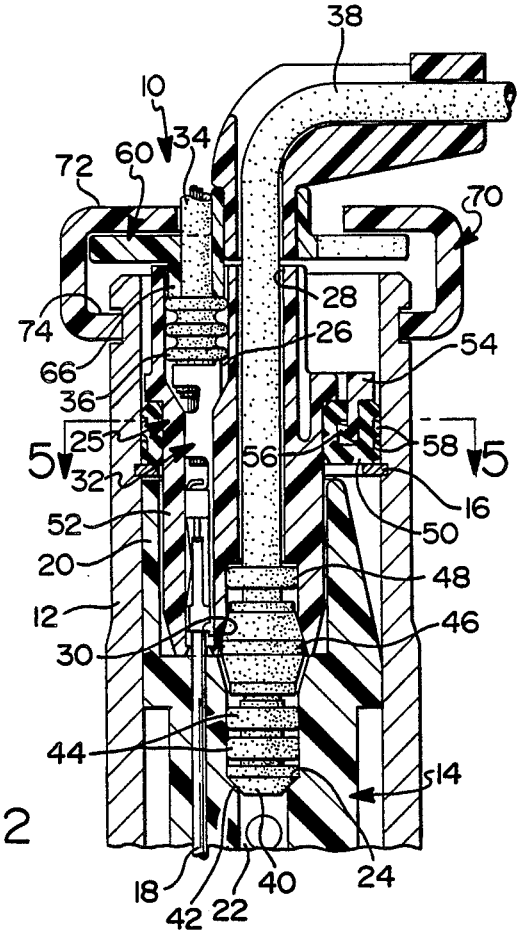
FIG. 2 is a section taken substantially along the line 2—2 of FIG. 1 looking in the direction of the arrows.
Figure 3:
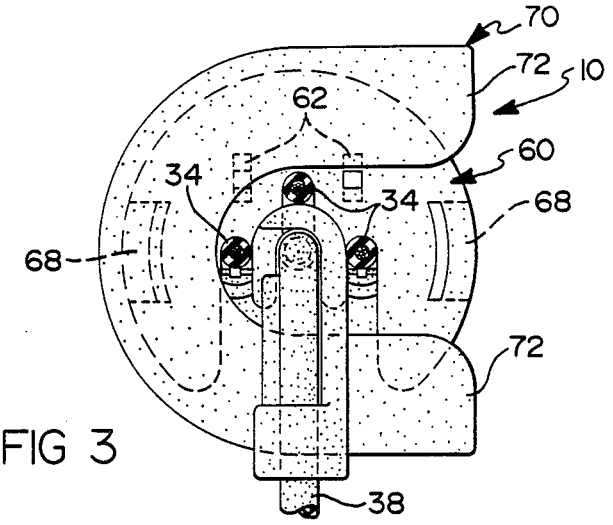
FIG. 3 is a top view taken substantially along the line 3—3 of FIG. 1 looking in the direction of the arrows.

The female connector body 25 also carries an external elastomeric seal sleeve 50 which seals between the female connector body 25 and the bore of the hollow piston rod 12. The seal sleeve 50 is mounted on a sector shaped portion 52 of the connector body 25 which is beneath a circular flange 54. See FIGS. 4 and 5. The flange 54 has a depending latch finger 56 which engages a latch shoulder in a cavity in a thickened portion of the seal sleeve 50 as shown in FIG. 2. The external seal sleeve 50 has a plurality of peripheral sealing lips 58 which sealingly engage the bore of the hollow piston rod 12.

Figure 4:
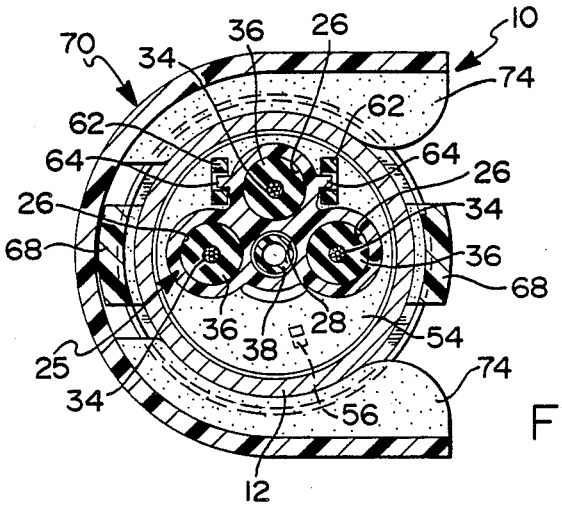
FIG. 4 is a section taken substantially along the line 4—4 of FIG. 1 looking in the direction of the arrows.
Figure 5:
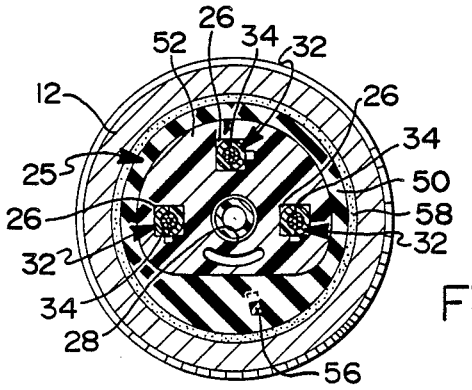
FIG. 5 is a section taken substantially along the line 5—5 of FIG. 2 looking in the direction of the arrows.

The female connector body 25 is retained in the piston rod 12 by a terminal position assurance (TPA) retainer 60. The retainer 60 has a first pair of latch arms 62 which engage lock nibs 64 of the female connector body 25 to lock the retainer 60 to the connector body 25 as shown in FIG. 4. The retainer 60 also has a plurality of bosses 66 which protrude into the conductor ends of the terminal cavities 26 and engage the individual seal sleeves 36 to insure that the terminals 32 are properly positioned in the terminal cavities 26 as shown in FIGS. 1 and 2. The TPA retainer 60 has a second pair of latch arms 68 which engage in an external groove of the hollow piston rod 12 to retain the female connector body 25 in the piston rod.

The proper positioning of the female connector body 25 and the TPA retainer 60 is assured by a connector position assurance (CPA) lock 70 in the form of C-shaped clamp having upper and lower flanges 72 and 74 which are spaced apart a predetermined distance which allows the lower flange 74 to slide laterally into the external groove of the piston rod 12 only if the TPA retainer 60 is properly connected to the piston ring 12 which in turn insures that the connector bodies 14 and 25 are properly mated. The opening of the lower flange 74 is less than the diameter of the groove as shown in FIG. 4 so that the CPA lock 70 is retained on the piston rod 12 when the lower flange 74 is snapped into position in the external groove. Thus, the TPA retainer 60 and the CPA lock 70 are both retained by the external groove of the hollow piston rod 12. Moreover, the CPA lock 70 traps one of the retainer latch arms 68 in the external groove as shown in FIG. 4 thereby providing additional security.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A sealed electrical and pneumatic connector for a hollow piston rod comprising a first connector body which is retained in the hollow piston rod and which has a plurality of electrical terminals which are arrayed around a central pneumatic passage in the connector body, a second connector body which is inserted into the hollow piston rod and plugged into the first connector body which is housed in the hollow piston rod, said second connector body having a plurality of terminal cavities which are arrayed around a central passage, said second connector body having electrical terminals housed in the terminal cavities which mate with the terminals of the first connector body when one connector body is plugged into the other connector body, said second connector body having a hose which is disposed in its central passage and which supports sealing means providing seals between the hose and the first connector body and between the hose and the second connector body respectively, the second connector body carrying an elastomeric seal sleeve which seals between the second connector body and the bore of the hollow piston rod, and a retainer for retaining the second connector body in the piston rod in mated engagement with the first connector body wherein:

said first connector body has a shroud and a pneumatic passage which is enlarged at the upper end to form a tapered seat and which opens into a cavity of the shroud, said second connector body has a central passage which has an enlarged lower end which terminates in a tapered seat, the hose is inserted into the central passage of the second connector body via the enlarged lower end of the central passage, the hose has a flange at its lower end which has a tapered face which mates with the tapered seat of the first connector body, the sealing means providing seals between the hose and the first connector body and between the hose and the second connector body comprises a lower elastomeric O-ring seal, an intermediate sleeve and an upper elastomeric O-ring seal which are disposed on the lower end of the hose above the flange, and said intermediate sleeve is slideably mounted on the hose and engages the tapered seat of the second connector body to insure that the lower O-ring is positioned properly for sealing engagement with the enlarged upper end of the central pneumatic passage in the first connector body.

2. A sealed electrical and pneumatic connector for a hollow piston rod comprising a first connector body which is retained in the hollow piston rod and which has a plurality of electrical terminals which are arrayed around a central pneumatic passage in the connector body, a second connector body which is inserted into the hollow piston rod and plugged into the first connector body which is housed in the hollow piston rod, said second connector body having a plurality of terminal cavities which are arrayed around a central passage, said second connector body having electrical terminals housed in the terminal cavities which mate with the terminals of the first connector body when one connector body is plugged into the other connector body, said second connector body having a hose which is disposed in its central passage and which supports sealing means providing seals between the hose and the first connector body and between the hose and the second connector body respectively, the second connector body carrying an elastomeric seal sleeve which seals between the second connector body and the bore of the hollow piston rod, and a retainer for retaining the second connector body in the piston rod in mated engagement with the first connector body wherein:

the elastomeric seal sleeve which seals between the second connector body and the bore of the piston rod is mounted on a sector shaped portion of the second connector body which is beneath a circular flange, and the circular flange has a depending latch finger which engages a latch shoulder in a cavity in a thickened portion of the seal sleeve to retain the seal sleeve.

3. A sealed electrical and pneumatic connector for a hollow piston rod comprising a first connector body which is retained in the hollow piston rod and which has a plurality of electrical terminals which are arrayed around a central pneumatic passage in the connected body, a second connector body which is inserted into the hollow piston rod and plugged into the first connector body which is housed in the hollow piston rod, said second connector body having a plurality of terminal cavities which are arrayed around a central passage, said second connector body having electrical terminals housed in the terminal cavities which mate with the terminals of the first connector body when one connector body is plugged into the other connector body, said second connector body having a hose which is disposed in its central passage and which supports sealing means providing seals between the hose and the first connector body and between the hose and the second connector body respectively, the second connector body carrying an elastomeric seal sleeve which seals between the second connector body and the bore of the hollow piston rod, and a retainer for retaining the second connector body in the piston rod in mated engagement with the first connector body wherein:

the retainer for retaining the second connector body in the piston rod in mated engagement with the first connector body has a first pair of latch arms which engage lock nibs of the second connector body to lock the retainer to the second connector body and a second pair of latch arms which engage in an external groove in the hollow piston rod to position and retain the second connector body in the hollow piston rod, and a connector position assurance lock in the form of a C-shaped clamp locks the retainer in place, said C-shaped clamp having upper and lower flanges which are spaced apart a predetermined distance which allows the lower flange to slide laterally into the external groove of the hollow piston rod only if the retainer is properly connected to the piston rod, and said lower flange having an opening which is less than the diameter of the external groove so that the C-shaped clamp is retained on the hollow piston rod when the lower flange is snapped into position in the external groove.

4. A sealed electrical and pneumatic connector for a hollow piston rod comprising:

a first connector body which is retained in the piston rod and which has a plurality of electrical terminals which are arrayed around a central pneumatic passage in the connector body, said pneumatic passage being enlarged at the upper end to form a tapered seat, a second connector body which is inserted into the hollow piston rod and plugged into the first connector body which is housed in the hollow piston rod, said second connector body having a plurality of terminal cavities which are arrayed around a central passage which has an enlarged lower end which terminates in a tapered seat, said second connector body having electrical terminals housed in the terminal cavities which mate with the terminals of the first connector body when one connector body is plugged into the other connector body, said terminals of the second connector body being attached to insulated conductors which have attached seal sleeves which seal the conductor ends of the terminal cavities, said second connector body having a hose which is inserted into its central passage via the enlarged lower end, said hose having a flange at its lower end which has a tapered face which mates with the tapered seat of the first connector body, said hose having a lower elastomeric O-ring seal, an intermediate sleeve and an upper elastomeric O-ring seal disposed on its lower end above the flange, said O-ring seals providing seals between the hose and the first connector body and between the hose and the second connector body respectively, said intermediate sleeve being slideably mounted on the hose and engaging the tapered seat of the second connector body to insure that the lower O-ring seal is positioned properly for sealing engagement with the enlarged upper end of the central pneumatic passage in the first connector body, the second connector body carrying an external elastomeric seal sleeve which seals between the second connector body and the bore of the hollow piston rod, and a retainer for retaining the second connector body in the hollow piston rod in mated engagement with the first connector body.

5. The sealed electrical and pneumatic connector as defined in claim 4 wherein:

the external seal sleeve is mounted on a sector shaped portion of the connector body which is beneath a flange which has a depending latch finger which engages a latch shoulder in a cavity in a thickened portion of the seal sleeve to retain the seal sleeve, and the external seal sleeve has a plurality of peripheral sealing lips which sealingly engage the bore of the hollow piston rod.

6. The sealed electrical and pneumatic connector as defined in claim 4 wherein:

the retainer has first latch means to lock the retainer to the connector body and second latch means which engage in an external groove in the hollow piston rod to position and retain the second connector body in the hollow piston rod, and a connector position assurance lack locks the retainer in place, said connector position assurance lock being in the form of a C-shaped clamp having upper and lower flanges which are spaced apart a predetermined distance which allows the lower flange to slide laterally into the external groove of the piston rod only if the retainer is properly connected to the piston rod, said lower flange having an opening which is less than the diameter of the external groove so that the C-shaped clamp is retained on the hollow piston rod when the lower flange is snapped into position in the external groove.

7. A sealed electrical and pneumatic connector for a hollow piston rod comprising:

a first connector body which is retained in the hollow piston rod and which has a plurality of electrical terminals which are arrayed around a central pneumatic passage in the connector body, said first connector body having a shroud, said pneumatic passage being enlarged at the upper end to form a tapered seat, and said enlarged upper end of the pneumatic passage opening into a cavity of the shroud, a second connector body which is inserted into the piston rod and plugged into the first connector body which is housed in the hollow piston rod, said second connector body having a plurality of terminal cavities which are arrayed around a central passage which has an enlarged lower end which terminates in a tapered seat, said second connector body having electrical terminals housed in the terminal cavities which mate with the terminals of the first connector body when one connector body is plugged into the other connector body, said terminals of the second connector body being attached to insulated conductors which have attached seal sleeves which seal the conductor ends of the terminal cavities, said second connector body having a hose which is inserted into its central passage via the enlarged lower end, said hose having a flange at its lower end which has a tapered face which mates with the tapered seat of the first connector body, said hose having a pair of lower elastomeric O-ring seals, an intermediate sleeve and an upper elastomeric O-ring seal disposed on its lower end above the flange, said O-ring seals providing seals between the hose and the first connector body and between the hose and the second connector body respectively, said intermediate sleeve being slideably mounted on the hose and engaging the tapered seat of the second connector body to insure that the lower O-ring seals are positioned properly for sealing engagement with the enlarged upper end of the central pneumatic passage in the first connector body, the second connector body carrying an external elastomeric seal sleeve which seals between the second connector body and the bore of the hollow piston rod, said external seal sleeve being mounted on a sector shaped portion of the connector body which is beneath a circular flange which has a depending latch finger which engages a latch shoulder in a cavity in a thickened portion of the seal sleeve to retain the seal sleeve, said external seal sleeve having a plurality of peripheral sealing lips which sealingly engage the bore of the hollow piston rod, a retainer for retaining the second connector body in the hollow piston rod in mated engagement with the first connector body, said retainer having a first pair of latch arms which engage lock nibs of the second connector body to lock the retainer to the second connector body and a second pair of latch arms which engage in an external groove in the hollow piston rod to position and retain the second connector body in the hollow piston rod, said retainer having a plurality of bosses which protrude into the conductor ends of the terminal cavities and engage the seal sleeves to insure that the terminals are properly positioned in the terminal cavities of the second connector body, and a connector position assurance lock in the form of a C-shaped clamp which locks the retainer in place, said C-shaped clamp having upper and lower flanges which are spaced apart a predetermined distance which allows the lower flange to slide laterally into the external groove of the piston rod only if the retainer is properly connected to the piston rod, said lower flange having an opening which is less than the diameter of the external groove so that the C-shaped clamp is retained on the hollow piston rod when the lower flange is snapped into position in the external groove.

* * * * *